US007010259B2

(12) United States Patent
Gila et al.

(10) Patent No.: US 7,010,259 B2
(45) Date of Patent: Mar. 7, 2006

(54) APPARATUS AND METHOD FOR CLEANING AN IMAGE TRANSFER DEVICE

(75) Inventors: Omer Gila, Cupertino, CA (US); Michael H. Lee, San Jose, CA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 51 days.

(21) Appl. No.: 10/799,808

(22) Filed: Mar. 12, 2004

(65) Prior Publication Data

US 2005/0201785 A1 Sep. 15, 2005

(51) Int. Cl.
*G03G 21/00* (2006.01)

(52) U.S. Cl. ..... 399/348; 399/358

(58) Field of Classification Search ..... 399/348, 399/358, 360, 123

See application file for complete search history.

(56) References Cited

U.S. PATENT DOCUMENTS

| | | | | |
|---|---|---|---|---|
| 3,722,993 | A * | 3/1973 | Egnaczak | 399/131 |
| 3,771,450 | A * | 11/1973 | Cleybergh | 101/425 |
| 4,284,345 | A | 8/1981 | Sugiyama et al. | |
| 4,436,054 | A | 3/1984 | Ceelen et al. | |
| 4,866,483 | A | 9/1989 | Davis et al. | |
| 4,891,676 | A | 1/1990 | Davis et al. | |
| 5,103,266 | A | 4/1992 | Miyamoto et al. | |
| 5,291,259 | A * | 3/1994 | Weitzel et al. | 399/356 |
| 5,406,364 | A | 4/1995 | Maeyama et al. | |
| 5,514,269 | A * | 5/1996 | Day et al. | 204/660 |
| 5,521,685 | A | 5/1996 | Barnes et al. | |
| 5,749,030 | A | 5/1998 | Park | |
| 5,854,962 | A | 12/1998 | Boockholdt et al. | |
| 5,999,791 | A | 12/1999 | Ogawa et al. | |
| 6,055,406 | A | 4/2000 | Kawai et al. | |
| 6,064,851 | A | 5/2000 | Saitoh | |
| 6,318,382 | B1 | 11/2001 | Katagiri et al. | |
| 6,330,421 | B1 | 12/2001 | Park et al. | |
| 6,879,804 | B1 * | 4/2005 | Park | 399/348 |

FOREIGN PATENT DOCUMENTS

| | | |
|---|---|---|
| JP | 60162279 | 8/1985 |
| JP | 03152587 | 6/1991 |
| JP | 06083248 | 3/1994 |
| JP | 2002132104 | 9/2002 |

* cited by examiner

*Primary Examiner*—Louis Arana

(57) ABSTRACT

An apparatus and method for cleaning an image transfer surface in an image transfer device. The cleaning apparatus includes a first cleaning station and a second cleaning station positioned to consecutively clean the image transfer surface. The first and second cleaning stations apply cleaning fluid to the image transfer surface and remove cleaning fluid with residual material from the image transfer surface. A first tank supplies cleaning fluid to, and receives cleaning fluid with residual material from, the first cleaning station. A second tank supplies cleaning fluid to, and receives cleaning fluid with residual material from, the second cleaning station. The second tank also supplies cleaning fluid to the first tank.

32 Claims, 5 Drawing Sheets

APPARATUS AND METHOD FOR CLEANING AN IMAGE TRANSFER DEVICE

BACKGROUND OF THE INVENTION

The present invention generally relates to image transfer technology and, more particularly, to an apparatus and method for removing contaminants from photoconducting surfaces of liquid electrophotographic printing components after printing, and a liquid electrophotographic printer having the cleaning apparatus.

As used herein, the term "printer" generally refers to all types of devices used for creating and/or transferring an image in a liquid electrophotographic process, including laser printers, copiers, facsimiles, and the like.

In a liquid electrophotographic (LEP) printer, an electrostatic latent image is created on the surface of an insulating, photoconducting material by selectively exposing areas of the photoconducting surface to light (such as a laser). A difference in electrostatic charge density is created between the areas on the photoconducting surface exposed and unexposed to light. The electrostatic latent image is developed into a visible image using developer liquid, which is a mixture of solid electrostatic toners or pigments dispersed in a carrier liquid serving as a solvent (referred to herein as "imaging oil"). The carrier liquid may be conductive or insulative, depending upon the particular printing process. The toners are selectively attracted to the photoconductor surface either exposed or unexposed to light, depending on the relative electrostatic charges of the photoconductor surface, development electrode, and toner. The photoconductor surface may be either positively or negatively charged, and the toner system similarly may contain negatively or positively charged particles. For LEP printers, the preferred embodiment is that the photoconductor surface and toner have the same polarity.

A sheet of paper is passed close to the photoconductor surface, which may be in the form of a rotating drum or a continuous belt, transferring the toner from the photoconductor surface onto the paper in the pattern of the image developed on the photoconductor surface. The transfer of the toner may be an electrostatic transfer, as when the sheet has an electric charge opposite that of the toner, or may be a heat transfer, as when a heated transfer roller is used, or a combination of electrostatic and heat transfer. In some printer embodiments, the toner may first be transferred from the photoconductor surface to an intermediate transfer medium, and then from the intermediate transfer medium to a sheet of paper.

During the image transfer process, it is desirable that the developed image on the photoconductor surface is completely transferred off of the photoconductor surface. However, in an actual printing process, some of the developed image may not be completely transferred, leaving residual materials such as toner, imaging oil, charge directors and other dissolved materials on the photoconductor surface. The residual materials on the photoconductor surface reduce the print quality of subsequently printed images and shorten the useful life of the photoconductor surface. Therefore, there is a need to remove the residual materials from the photoconductor surface.

One existing device for removing residual materials from the photoconductor surface utilizes a wetting roller to place a layer of imaging oil (for example, an approximately 100$\mu$ layer of oil) on the photoconductor surface. A sponge roller subsequently is rubbed against the photoconductor surface to clean the surface and absorb the now dirty imaging oil and materials therein. A squeegee roller then squeezes the sponge roller to at least partially remove the dirty oil and materials therein from the sponge roller. Finally, a rubber blade is used to scrape the photoconductor surface and remove most of the remaining imaging oil from the photoconductor surface.

Although the described cleaning method does clean much of the residual material from the photoconductor surface, a layer of dirty imaging oil remains on the photoconductor surface. The dirty imaging oil contains charge directors and other dissolved materials that cause lateral conductivity on the photoconductor surface and that react with the printer environment to generate sticky materials that slowly but steadily coat the photoconductor surface. The print quality of the printer is thus adversely affected and the life of the photoconductor is shortened. It is desired to leave a cleaner layer of imaging oil on the photoconductor surface, and thus an improved apparatus and method for cleaning the photoconductor surface is desirable.

SUMMARY OF THE INVENTION

The invention described herein provides an apparatus and method for cleaning an image transfer surface in an image transfer device. In one embodiment, the cleaning apparatus includes a first cleaning station and a second cleaning station. The first and second cleaning stations are positioned to consecutively clean the image transfer surface. The first and second cleaning stations apply cleaning fluid to the image transfer surface and remove cleaning fluid with residual material from the image transfer surface. A first tank in fluid communication with the first cleaning station supplies cleaning fluid to the first cleaning station, and receives cleaning fluid with residual material from the first cleaning station. A second tank in fluid communication with the second cleaning station supplies cleaning fluid to the second cleaning station, and receives cleaning fluid with residual material from the second cleaning station. The second tank is also in fluid communication with the first tank, and supplies cleaning fluid to the first tank.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
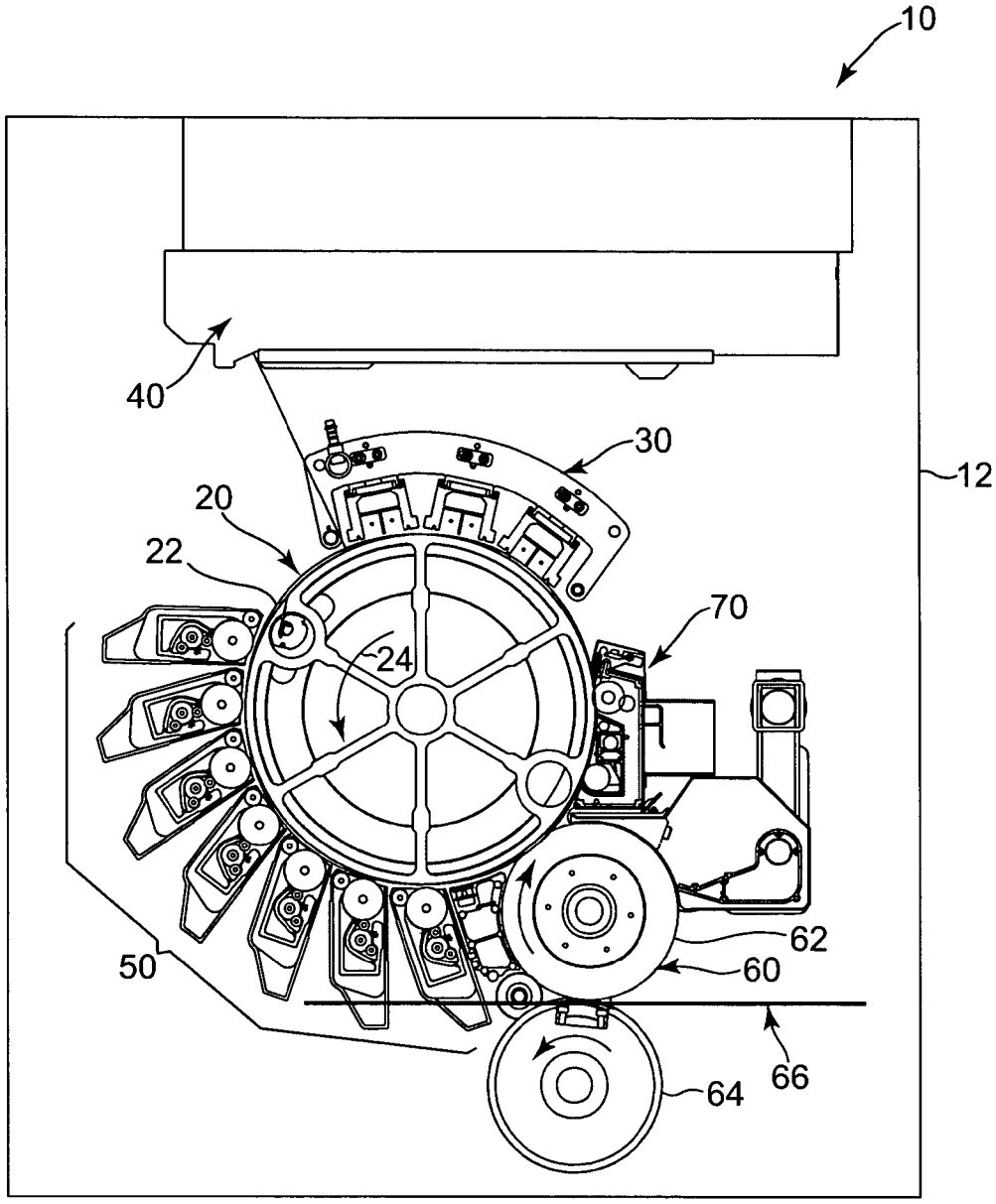
FIG. 1 is a schematic view of an exemplary image transfer device, showing a liquid electrophotographic printer having a cleaning apparatus according to one embodiment of the invention.

An exemplary image transfer device having an image transfer surface, specifically an LEP printer 10 having a photoconductor surface 22, is schematically shown in FIG. 1. Although, for purpose of clarity, embodiments according to the invention are illustrated herein with respect to an LEP printer having a photoconductor surface, the invention is understood to be applicable and useful with other embodiments of image transfer surfaces and image transfer devices. As illustrated, the LEP printer 10 includes a printer housing 12 having installed therein a photoconductor drum 20 having the photoconductor surface 22. Photoconductor drum 20 is rotatably mounted within printer housing 12 and rotates in the direction of arrow 24. Several additional printer components surround the photoconductor drum 20, including a charging device 30, an exposure device 40, a development device 50, an image transfer device 60, and a cleaning apparatus 70.

The charging device 30 charges the photoconductor surface 22 on the drum 20 to a predetermined electric potential (typically ±500 to 1000 V). The exposure device 40 forms an electrostatic latent image on the photoconductor surface 22 by scanning a light beam (such as a laser) according to the image to be printed onto the photoconductor surface 22. The electrostatic latent image is due to a difference in the surface potential between the exposed and unexposed portion of the photoconductor surface 22. The exposure device 40 exposes images on photoconductor surface 22 corresponding to various colors, for example, yellow (Y), magenta (M), cyan (C) and black (K), respectively. Exposure device 40 may have a single scanning device for exposing different image colors consecutively, or multiple scanning devices for exposing different image colors concurrently. The development device 50 supplies development liquid, which is a mixture of solid toner and imaging oil, to the photoconductor surface 22 to adhere the toner to the portion of the photoconductor surface 22 where the electrostatic latent image is formed, thereby forming a visible toner image on the photoconductor surface 22. The development device 50 may supply various colors of toner corresponding to the color images exposed by the exposure device 40. The image transfer device 60 includes an intermediate transfer roller 62 in contact with the photoconductor surface 22, and a fixation or impression roller 64 in contact with the transfer roller 62. As the transfer roller 62 is brought into contact with the photoconductor surface 22, the image is transferred from the photoconductor surface 22 to the transfer roller 62. A printing sheet 66 is fed between the transfer roller 62 and the impression roller 64 to transfer the image from the transfer roller 62 to the printing sheet 66. The impression roller 64 fuses the toner image to the printing sheet 66 by the application of heat and/or pressure. The cleaning apparatus 70 cleans the photoconductor surface 22 of residual material using a cleaning fluid before the photoconductor surface 22 is used for printing subsequent images. In one embodiment according to the invention, the cleaning fluid is imaging oil as used by the development device 50.

Although not shown in FIG. 1, the liquid electrophotographic printer 10 further includes cleaning solution supply device 80 (FIG. 4) for continuously supplying cleaning fluid to the cleaning apparatus 70, a printing sheet feeding device for supplying printing sheets to image transfer device 60, and a printing sheet ejection device for ejecting printed sheets from the printer 10. As noted above, in one embodiment the cleaning fluid is imaging oil, and the supply device 80 continuously supplies imaging oil to the development device 50 and the cleaning apparatus 70. The imaging oil supply device 80 is discussed in greater detail below.

Figure 2:
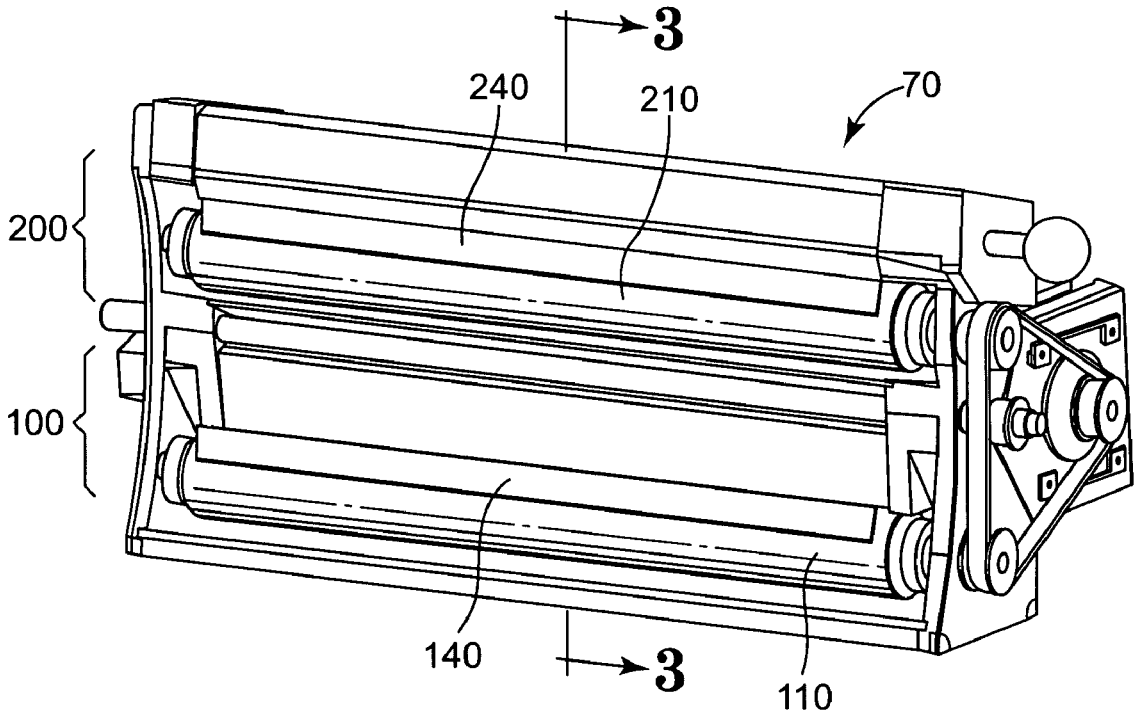
FIG. 2 is a schematic elevational view of one embodiment of a cleaning apparatus according to the invention.
Figure 3:
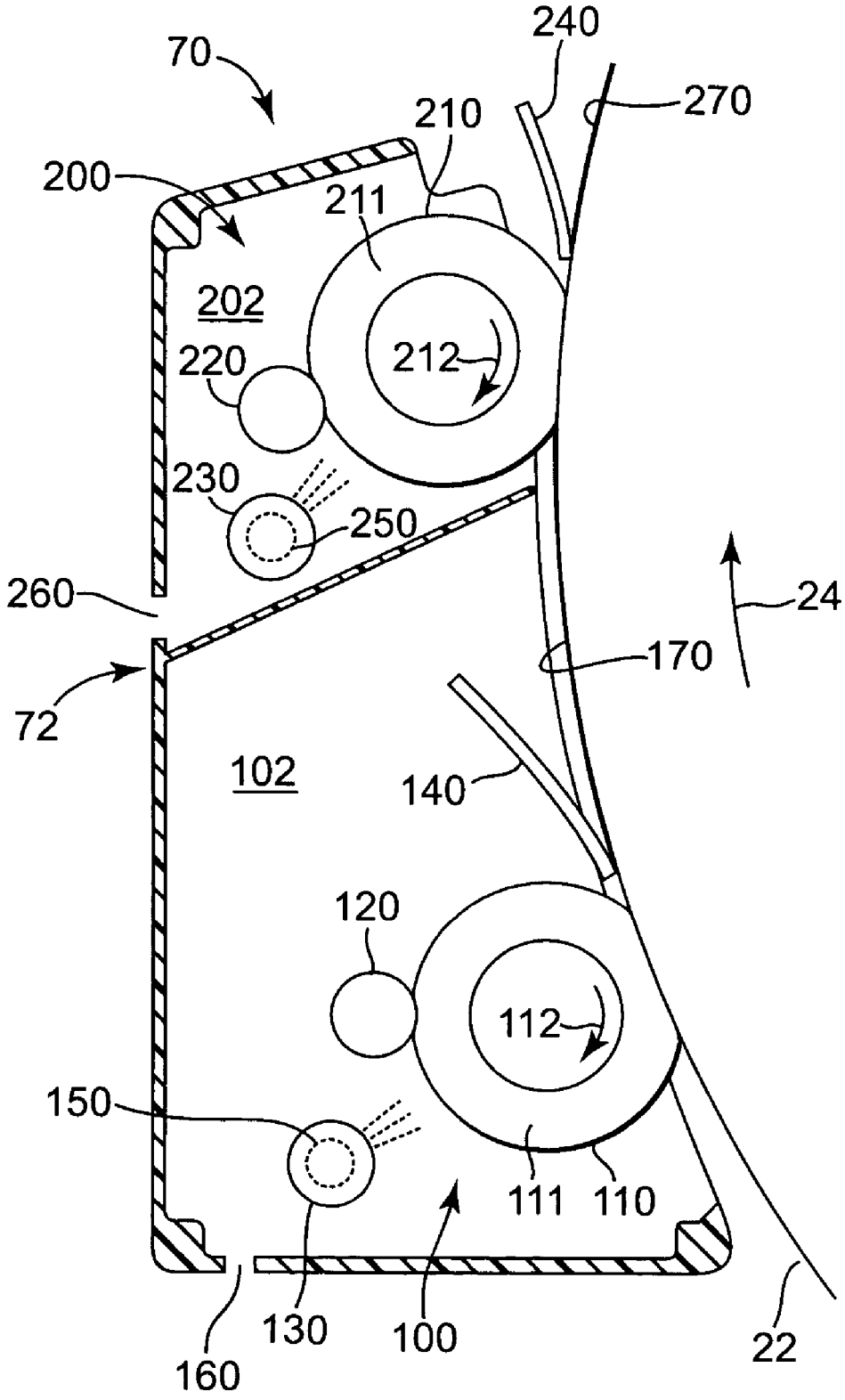
FIG. 3 is a cross-sectional view taken along line 3—3 of FIG. 2.

FIGS. 2 and 3 illustrate one embodiment of a cleaning apparatus 70 according to the present invention. The cleaning apparatus 70 includes a housing 72 containing a first cleaning station 100 and a second cleaning station 200. The first and second cleaning stations 100, 200 are positioned in fluidically separate compartments 102, 202, respectively, within the housing 72. In alternate embodiments, the cleaning station compartments 102, 202 themselves may comprise separate housings for each of the first and second cleaning stations 100, 200. The first and second cleaning stations 100, 200 are positioned such that they consecutively clean the photoconductor surface 22 as the photoconductor drum 20 rotates past the cleaning apparatus 70 in the direction of arrow 24, in the manner described below.

The first cleaning station 100 includes a sponge roller 110 that functions as a cleaning fluid applicator. Sponge roller 110 preferably includes at least an outer layer 111 of pliable, absorptive material. Preferred materials of outer layer 111 are resistant to degradation by the cleaning fluid, may be either conductive or non-conductive, and may be either open or closed cell foam. Exemplary suitable materials include rubbers and urethanes. First cleaning station 100 further includes a squeegee roller 120, an imaging oil spray bar 130 that functions as a cleaning fluid dispenser, and a resilient blade 140. Squeegee roller 120 is formed from a hard material such as a metal, while blade 140 is formed from a material such as rubber or urethane. As described below, sponge roller 110 and blade 140 are pressed against photoconductor surface 22, and are therefore preferably formed of soft, resilient or pliable materials to avoid causing damage to photoconductor surface 22. Sponge roller 110 and blade 140 are both wider than the image on photoconductive surface 22, and the width of blade 140 may be smaller than the width of sponge roller 110. An oil inlet 150 supplies imaging oil to spray bar 130 from a first oil tank 82 of the imaging oil supply device 80. An oil outlet 160 positioned at the bottom of the first cleaning station compartment 102 collects imaging oil and materials therein, and returns it to the first oil tank 82.

The second cleaning station 200 is constructed similarly to the first cleaning station 100. The second cleaning station 200 includes a sponge roller 210 that functions as a cleaning fluid applicator. Sponge roller 210 preferably includes at least an outer layer 211 of pliable, absorptive material. Preferred materials of outer layer 211 are resistant to degradation by the cleaning fluid, may be either conductive or non-conductive, and may be either open or closed cell foam. Exemplary suitable materials include rubbers and urethanes. Second cleaning station further includes a squeegee roller 220, an imaging oil spray bar 230 that functions as a cleaning fluid dispenser, and a resilient blade 240. Squeegee roller 220 is formed from a hard material such as a metal, while blade 240 is formed from a material such as rubber or urethane. As described below, sponge roller 210 and blade 240 are pressed against photoconductor surface 22, and are therefore preferably formed of soft, resilient or pliable materials to avoid causing damage to photoconductor surface 22. Sponge roller 210 and blade 240 are both wider than the image on photoconductive surface 22, and the width of blade 240 may be smaller than the width of sponge roller 210. In one embodiment, the blade 140 of the first cleaning station 100 is slightly wider than the sponge roller 210 and blade 240 of the second cleaning station 200. In this manner, dirty oil and residual material from the sides of photoconductor surface 22 is prevented from collecting in the second cleaning station 200. An oil inlet 250 supplies imaging oil to spray bar 230 from a second oil tank 84 of the imaging oil supply device 80. An oil outlet 260 positioned at the bottom of the second cleaning station compartment 202 collects imaging oil and materials therein, and returns it to the second oil tank 84 of the imaging oil supply device 80.

The sponge rollers 110, 210 and squeegee rollers 120, 220 of first and second cleaning stations 100, 200 are rotatably driven by a motor (not shown) using known means, such as a combination of drive shafts, drive belts, pulleys and gears. Sponge rollers 110, 210 are rotated at a rate selected to produce a desired scrubbing or rubbing motion between the sponge rollers 110, 210 and the photoconductive surface 22.

Figure 4:
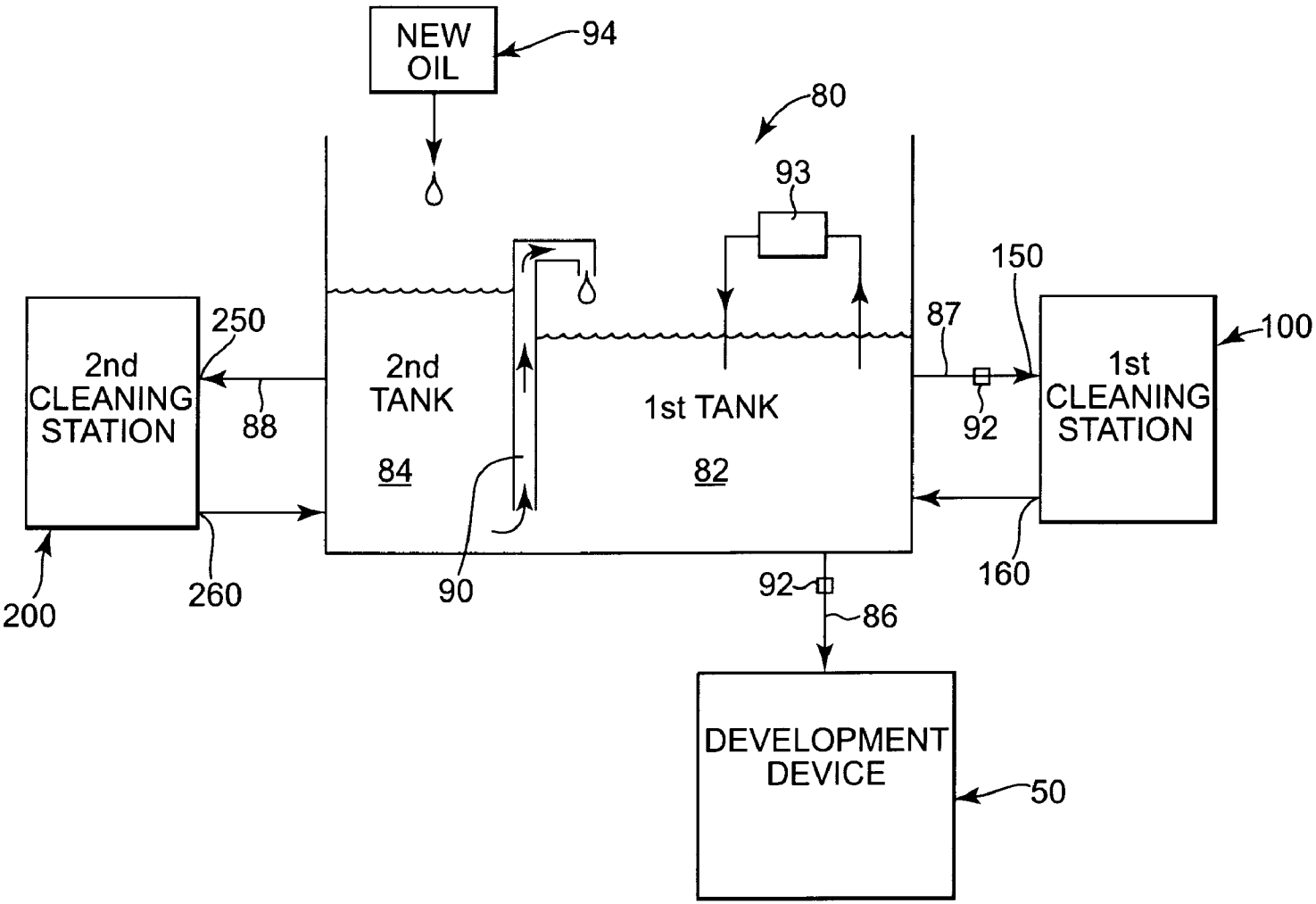
FIG. 4 is a schematic representation of an imaging oil supply device used with one embodiment of a cleaning apparatus according to the invention.

As shown schematically in FIG. 4, the imaging oil supply device 80 includes first (or main) imaging oil tank 82, and second (or clean) imaging oil tank 84. The first tank 82 supplies imaging oil to the development device 50 via a fluid conduit 86 and also to fluid inlet 150 of the first cleaning station 100 via a fluid conduit 87. Fluid conduits 86, 87 may optionally include a fluid filter 92 therein, or a recirculation filter 93 may optionally be provided to remove contaminants from the imaging oil in first tank 82. The second tank 84 supplies imaging oil to fluid inlet 250 of second cleaning station 200 via a fluid conduit 88. First tank 82 and second tank 84 are also fluidically connected by a fluid conduit 90, such that as the volume of imaging oil in first tank 82 decreases (due to use by development device 50 and first cleaning station 100), imaging oil from second tank 84 is transferred to first tank 82. Replenishment of first tank 82 from second tank 84 may occur either periodically or continuously. Second tank 84 is either periodically or continuously replenished with clean imaging oil from a clean oil source 94. The clean oil source 94 may be external to the LEP printer 10, or may be a separate reservoir within LEP printer 10.

The cleaning of photoconductor surface 22 by the cleaning apparatus 70 will now be described. As the photoconductor surface 22 passes the first cleaning station 100, a first portion of residual material (referred to herein as contamination or contaminates) is cleaned from the photoconductor surface 22. As the sponge roller 110 of the first cleaning station 100 rotates in the direction of arrow 112, the sponge roller 110 is wetted with first tank 82 imaging oil sprayed from spray bar 130. In one embodiment, the spray bar 130 is positioned such that the sponge roller 110 is wetted immediately prior to making contact with the squeegee roller 120. As the squeegee roller 120 squeezes the wetted sponge roller 110, imaging oil and materials therein are partially removed from the sponge roller 110. Next, the partially wet sponge roller 110 is pressed and rubbed against the photoconductor surface 22, such that residual material on the photoconductor surface 22 is loosened and removed, with some of the imaging oil and residual material being absorbed by the sponge roller 110 as it moves away from contact with photoconductor surface 22. After the now dirty portion of sponge roller 110 moves away from contact with photoconductor surface 22, the sponge roller 110 is wetted again with imaging oil. Finally, as photoconductor surface 22 continues to rotate past the first cleaning station 100, the blade 140 scrapes the photoconductor surface 22 and removes most of the remaining imaging oil from the photoconductor surface 22. A layer of imaging oil 170 with some contaminants therein (referred to herein as a layer 170 of dirty imaging oil) remains on the photoconductor surface 22 as it passes from the first cleaning station 100 to the second cleaning station 200. The layer 170 of dirty imaging oil leaving the first cleaning station 100 may be, for example, approximately $0.1\mu$. The oil and residual material removed by squeegee roller 120 and blade 140 is collected at the bottom of the first cleaning station compartment 102 and returned to the first imaging oil tank 82 by the oil outlet 160.

As the photoconductor surface 22 passes the second cleaning station 200, a second portion of residual material is cleaned from the photoconductor surface 22. As the sponge roller 210 of the second cleaning station 200 rotates in the direction of arrow 212, the sponge roller 210 is wetted with second tank 84 imaging oil sprayed from spray bar 230. In one embodiment, the spray bar 230 is positioned such that the sponge roller 210 is wetted immediately prior to making contact with the squeegee roller 220. As the squeegee roller 220 squeezes the wetted sponge roller 210, imaging oil and materials therein are partially removed from the sponge roller 210. Next, the partially wet sponge roller 210 is pressed and rubbed against the photoconductor surface 22, such that the layer 170 of dirty imaging oil that passed from the first cleaning station 100 is diluted with clean oil (from the second oil tank 84). Some of the imaging oil and residual material is absorbed by the sponge roller 210 as it moves away from contact with photoconductor surface 22. After the sponge roller 210 moves away from contact with photoconductor surface 22, the sponge roller 210 is wetted again with clean imaging oil from the second oil tank 84. Finally, the blade 240 scrapes the photoconductor surface 22, removes most of the remaining imaging oil, and leaves a layer 270 of imaging oil on the photoconductor surface 22 (referred to herein as a layer 270 of cleaner imaging oil) as the photoconductor surface 22 rotates past the second cleaning station 200. The cleaner layer 270 of imaging oil leaving the second cleaning station 200 may be, for example, approximately $0.1\mu$. The oil and residual material removed by squeegee roller 220 and blade 240 is collected at the bottom of the second cleaning station compartment 202 and returned to the second imaging oil tank 84 by the oil outlet 260.

In one embodiment, the approximately $0.1\mu$ layer 170 of dirty oil leaving the first cleaning station 100 is mixed with approximately $50\mu$ of clean oil in the second cleaning station 200, resulting in a $0.1\mu$ layer 270 of cleaner oil leaving the second cleaning station 200. The layer 270 of cleaner oil leaving the second cleaning station 200 is cleaner than the layer 170 of dirty oil leaving the first cleaning station 100 by a factor of approximately 50.

The above described cleaning operation is continuously performed during printing. After printing, the sponge rollers 110, 210 are separated from the photoconductor surface 22 by a predetermined distance to prevent compressive set of the sponge rollers when the printer isn't operating.

Initially, both the first tank 82 and the second tank 84 of imaging oil supply device 80 contain clean imaging oil. As photoconductor surface 22 is cleaned using the process described above, the contamination rate of the first tank 82 is much higher than the contamination rate of the second tank 84, because the first cleaning station 100 collects the dirtiest oil from the photoconductor surface 22 and returns that oil to the first tank 82. The dirty oil from the first tank 82 is re-supplied to the first cleaning station 100, and then collected and returned again to the first tank 82. In contrast, the imaging oil collected by the second cleaning station 200 is relatively clean (the dirtiest oil having been collected and retained by the first cleaning station 100 and first tank 82). Thus, the imaging oil in the second tank 84 becomes contaminated more slowly than the imaging oil in the first tank 82. In addition, the development device 50 uses imaging oil from the first tank 82, such that the volume of imaging oil in the first tank 82 gradually decreases. The first tank 82 is replenished with less contaminated oil from the second tank 84, and the second tank 84 is replenished with new or clean imaging oil from source 94. This addition of clean oil to the second tank 84 further reduces its contamination rate.

EXAMPLE

Figure 5:
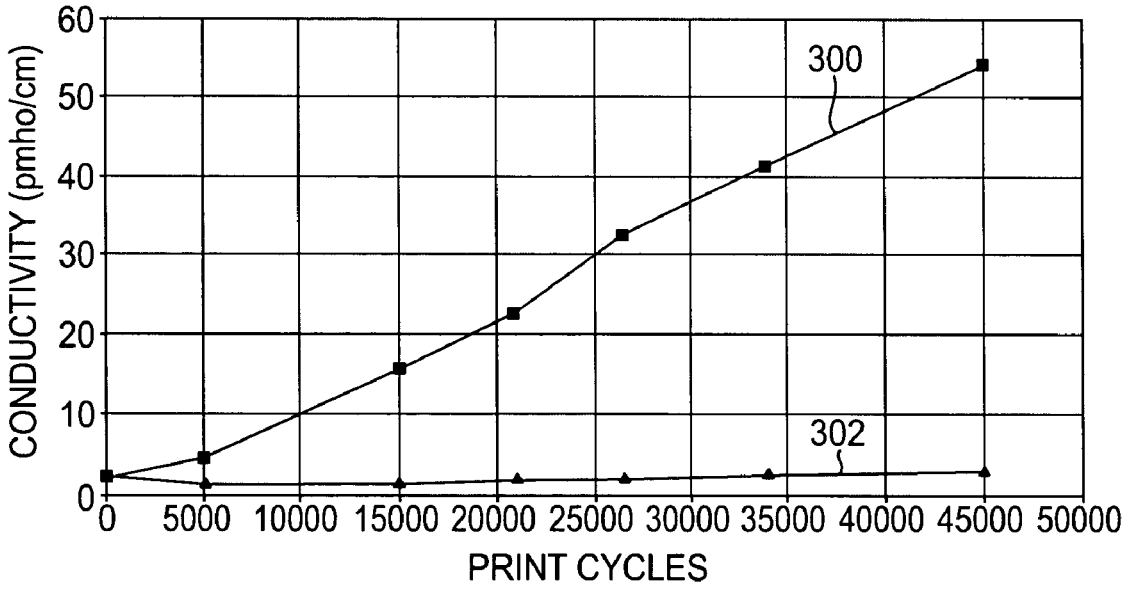
FIG. 5 is an exemplary graph of the imaging oil contamination using one embodiment of a cleaning apparatus according to the invention.

A LEP printer having a cleaning apparatus 70 as described above was operated for 45,000 printing cycles. The change in contamination of the imaging oil in the first tank 82 and second tank 84 is illustrated in the graph of FIG. 5. Contamination of the imaging oil is represented by the oil conductivity, as charge director concentration is proportional to the oil conductivity. After completion of 45,000 printing cycles, the second tank 84 had a conductivity of 3 pmho/cm, as illustrated by line 300, while the first tank 82 had a conductivity of 55 pmho/cm, as illustrated by line 302. Over the course of 45,000 printing cycles, the LEP printer consumed 6 liters of imaging oil from the first tank 82. The imaging oil used from the first tank 82 was replaced with the 3 pmho/cm oil from the second tank 84, while the 3 pmho/cm oil in the second tank 84 was replaced with 0 pmho/cm oil.

As described herein, the liquid electrophotograpic printer with the cleaning apparatus 70 according to the present invention continuously removes residual materials and contaminants from the photoconductor surface 22 while printing, and supplies a layer of cleaner imaging oil to the photoconductor surface 22 as it leaves the cleaning apparatus 70. The configuration of the cleaning apparatus 70 effectively filters imaging oil in the imaging oil supply device in real time during operation of the LEP printer. Thus, the rate of deterioration of print quality is decreased and the life span of the photoconductor surface 22 is increased.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the mechanical, electro-mechanical, and electrical arts will readily appreciate that the present invention may be implemented in a very wide variety of embodiments. For example, the cleaning apparatus described herein may include more than the two cleaning stations shown and described. The cleaning apparatus may also be used to clean other components of the LEP printer, such as the transfer roller. This application is intended to cover any adaptations or variations of the preferred embodiments discussed herein. Therefore, it is manifestly intended that this invention be limited only by the claims and the equivalents thereof.

What is claimed is:

1. An apparatus for cleaning an image transfer surface in an image transfer device, comprising:

a first cleaning station for applying cleaning fluid to the image transfer surface and removing cleaning fluid with a first portion of residual material from the image transfer surface;

a second cleaning station for applying cleaning fluid to the image transfer surface and removing cleaning fluid with a second portion of residual material from the image transfer surface, wherein the first and second cleaning stations are positioned to consecutively clean the image transfer surface;

a first tank in fluid communication with the first cleaning station, the first tank supplying cleaning fluid to the first cleaning station, and receiving cleaning fluid with residual material from the first cleaning station; and a second tank in fluid communication with the second cleaning station, and in fluid communication with the first tank, the second tank supplying cleaning fluid to the second cleaning station, and receiving cleaning fluid with residual material from the second cleaning station, and supplying cleaning fluid to the first tank.

2. The apparatus of claim 1, wherein the first cleaning station has an associated width in which cleaning fluid is applied and removed that is larger than an imaged width on the image transfer surface, and wherein the second cleaning station has an associated width in which cleaning fluid is applied and removed that is larger than the imaged width and smaller than the associated width of the first cleaning station.

3. The apparatus of claim 1, further comprising a cleaning fluid source supplying cleaning fluid to the second tank.

4. The apparatus of claim 1, wherein the first cleaning station includes a fluid inlet for receiving cleaning fluid from the first tank, and a fluid outlet for returning cleaning fluid with residual material to the first tank, and wherein the second cleaning station includes a fluid inlet for receiving cleaning fluid from the second tank, and a fluid outlet for returning cleaning fluid with residual material to the second tank.

5. The apparatus of claim 1, wherein the first and second cleaning stations are contained in a common housing.

6. The apparatus of claim 1, wherein the first tank supplies and receives cleaning fluid from the first cleaning station prior to the second tank supplying and receiving cleaning fluid from the second cleaning station, whereby a concentration of residual material in the cleaning fluid of the first tank increases at a faster rate than a concentration of residual material in the cleaning fluid of the second tank.

7. The apparatus of claim 6, whereby the first portion of residual material removed from the photoconductor surface is greater than the second portion of residual material removed from the photoconductor surface.

8. The apparatus of claim 1, wherein each of the first and second cleaning stations comprise:

a cleaning fluid applicator for contacting the image transfer surface to apply cleaning fluid to the image transfer surface and remove cleaning fluid containing residual material from the image transfer surface; and a cleaning blade for pressing against the image transfer surface for removing cleaning fluid and residual material from the image transfer surface.

9. The apparatus of claim 8, wherein the cleaning fluid applicator comprises a sponge roller.

10. The apparatus of claim 9, wherein the sponge roller includes at least an outer layer of pliable, absorptive material.

11. The apparatus of claim 8, wherein each of the first and second cleaning stations further comprise a cleaning fluid dispenser for wetting the cleaning fluid applicator with cleaning fluid received from the first and second tanks, respectively.

12. The apparatus of claim 11, wherein the cleaning fluid dispenser comprises a spray bar.

13. The apparatus of claim 1, further comprising a cleaning fluid filter disposed between the second tank and the first tank.

14. A liquid electrophotographic (LEP) device comprising:

a photoconductive surface for creating an image thereon, the image formed by liquid including imaging oil;

a cleaning apparatus for cleaning the photoconductor surface, the cleaning apparatus including a first cleaning station and a second cleaning station, the first and second cleaning stations positioned to consecutively clean the photoconductor surface;

a first cleaning fluid tank fluidically connected to the first cleaning station for supplying cleaning fluid to the first cleaning station; and a second cleaning fluid tank fluidically connected to the second cleaning station and to the first tank for supplying cleaning fluid to the second cleaning station and to the first tank.

15. The liquid electrophotographic device of claim 14, wherein the first tank supplies and receives cleaning fluid from the first cleaning station prior to the second tank supplying and receiving cleaning fluid from the second cleaning station, whereby a contamination level of the cleaning fluid in the first tank increases at a faster rate than a contamination level of the cleaning fluid in the second tank.

16. The liquid electrophotographic device of claim 14, further comprising an external cleaning fluid source for replenishing the second tank with cleaning fluid.

17. The liquid electrophotographic device of claim 14, wherein the cleaning fluid is imaging oil.

18. The liquid electrophotographic device of claim 17, further comprising a development device for developing a latent image on the photoconductor surface to obtain the image formed by liquid including imaging oil, wherein the first tank is further fluidically connected to the development device to supply imaging oil to the development device.

19. The liquid electrophotographic device of claim 14, further comprising:

an exposure device for forming a latent image on the photoconductor surface;

a development device for developing the latent image on the photoconductor surface to obtain the image formed by liquid including imaging oil; and an image transfer device for transferring the image from the photoconductor surface to a printing sheet.

20. The liquid electrophotographic device of claim 14, wherein each of the first and second cleaning stations comprise:

a first roller for contacting the photoconductor surface to apply cleaning fluid to the photoconductor surface and absorb cleaning fluid containing residual contamination from the photoconductor surface; and a cleaning blade for pressing against the photoconductor surface for removing cleaning fluid and residual contamination from the photoconductor surface.

21. The liquid electrophotographic device of claim 20, wherein each of the first and second cleaning stations further comprise a second roller for contacting the first roller to remove cleaning fluid from the first roller.

22. The liquid electrophotographic device of claim 20, wherein each of the first and second cleaning stations further comprise a spray bar for wetting the first roller with cleaning fluid received from the first and second cleaning fluid tanks, respectively.

23. The liquid electrophotographic device of claim 14, wherein the photoconductor surface is on a drum.

24. The liquid electrophotographic device of claim 14, wherein the photoconductor surface is on a continuous belt.

25. An apparatus for cleaning an image transfer surface in an image transfer device, comprising:

a first sponge roller for contacting the image transfer surface to apply cleaning fluid from a first tank to the image transfer surface and absorb cleaning fluid and residual material from the image transfer surface;

a first squeegee roller for contacting the first sponge roller to remove cleaning fluid and residual material from the first sponge roller;

a first cleaning blade for pressing against the image transfer surface for removing cleaning fluid and residual material remaining on the image transfer surface after contact with the first sponge roller;

a second sponge roller for contacting the image transfer surface to apply cleaning fluid from a second tank to the image transfer surface and absorb cleaning fluid and residual material from the image transfer surface;

a second squeegee roller for contacting the second sponge roller to remove cleaning fluid and residual material from the second sponge roller; and a second cleaning blade for pressing against the image transfer surface for removing cleaning fluid and residual material remaining on the image transfer surface after contact with the second sponge roller;

wherein cleaning fluid and residual material removed by the first sponge roller, squeegee roller and cleaning blade is returned to the first tank, wherein cleaning fluid and residual material removed by the second sponge roller, squeegee roller and cleaning blade is returned to the second tank, and wherein the first tank is fluidically connected with and replenished with cleaning fluid from the second tank.

26. A method of cleaning residual material from an image transfer surface in an image transfer device, the method comprising:

positioning a first cleaning station and a second cleaning station to consecutively clean the image transfer surface;

supplying the first cleaning station with a first cleaning fluid from a first tank;

supplying the second cleaning station with a second cleaning fluid from a second tank; and refreshing the cleaning fluid in the first tank with cleaning fluid from the second tank.

27. The method of claim 26, further comprising:

applying the first cleaning fluid to the image transfer surface within the first cleaning station;

removing the first cleaning fluid and residual material therein from the image transfer surface within the first cleaning station;

returning the first cleaning fluid and residual material therein to the first tank;

applying the second cleaning fluid to the image transfer surface within the second cleaning station;

removing the second cleaning fluid and residual material therein from the image transfer surface within the second cleaning station; and returning the second cleaning fluid and residual material therein to the second tank.

28. The method of claim 27, wherein removing the first cleaning fluid and residual material therein from the image transfer surface within the first cleaning station includes removing a first portion of contaminated cleaning fluid, and wherein applying the second cleaning fluid to the image transfer surface within the second cleaning station includes diluting a remaining portion of contaminated cleaning fluid on the image transfer surface.

29. The method of claim 27, wherein applying the first cleaning fluid to the image transfer surface within the first cleaning station and removing the first cleaning fluid and residual material therein from the image transfer surface within the first cleaning station comprises:

wetting a sponge roller with the first cleaning fluid; and rubbing the wetted sponge roller against the image transfer surface.

30. The method of claim 27, wherein applying the second cleaning fluid to the image transfer surface within the second cleaning station and removing the second cleaning fluid and residual material therein from the image transfer surface within the second cleaning station comprises:

wetting a sponge roller with the second cleaning fluid; and rubbing the wetted sponge roller against the image transfer surface.

31. A method of cleaning residual material from an image transfer surface in an image transfer device, the method comprising:

applying a first cleaning fluid to an image transfer surface having residual material thereon;

removing a first portion of the first cleaning fluid and residual material therein from the image transfer surface;

diluting a remaining portion of first cleaning fluid and residual material therein with a second cleaning fluid; and removing a first portion of the diluted cleaning fluid and residual material therein from the image transfer surface.

32. The method of claim 31, further comprising:

replenishing the first cleaning fluid with the second cleaning fluid.

* * * * *